United States Patent [19]

Bares

[11] Patent Number: 4,924,263

[45] Date of Patent: May 8, 1990

[54] QUALITY CONTROL FOR MAGNETIC IMAGES

[75] Inventor: Jan Bares, Webster, N.Y.

[73] Assignee: Xerox Corporation, Stamford, Conn.

[21] Appl. No.: 336,285

[22] Filed: Apr. 10, 1989

[51] Int. Cl.[5] ..... G03G 15/00; G03G 15/09

[52] U.S. Cl. ..... 355/203; 355/204; 355/208; 355/246; 355/214; 430/30

[58] Field of Search ..... 355/203, 204, 208, 214, 355/246; 430/30; 222/52, 55, 56

[56] References Cited

U.S. PATENT DOCUMENTS

| | | | |
|---|---|---|---|
| 3,858,514 | 1/1975 | Beebe et al. | 101/426 |
| 3,993,484 | 11/1976 | Rait et al. | 96/1.4 |
| 4,312,589 | 1/1982 | Brannan et al. | 355/208 |
| 4,326,646 | 4/1982 | Lavery et al. | 222/56 |
| 4,372,672 | 2/1983 | Pries | 356/448 |
| 4,502,778 | 3/1985 | Dodge et al. | 355/204 |
| 4,514,480 | 4/1985 | Wada et al. | 430/30 |
| 4,550,998 | 11/1985 | Nishikawa | 355/203 X |
| 4,563,086 | 1/1986 | Knapp et al. | 355/246 |
| 4,575,224 | 3/1986 | Arnold | 355/203 |
| 4,592,645 | 6/1986 | Kanai et al. | 355/206 |
| 4,619,522 | 10/1986 | Imai | 355/246 |
| 4,632,537 | 12/1986 | Imai | 355/203 |
| 4,734,740 | 3/1988 | Fujii et al. | 355/206 |

*Primary Examiner*—A. C. Prescott

*Attorney, Agent, or Firm*—H. Fleischer; J. E. Beck; R. Z. Zibelli

[57] ABSTRACT

A printing machine in which magnetically permeable marking particles develop a latent image recorded on a photoconductive member. A read head is positioned adjacent the photoconductive member to detect magnetic field intensity effects produced by the marking particles. In addition, an optical device may be used to transmit a light beam onto the marking particles developed on the latent image and to sense the intensity of the light rays reflected therefrom. The read head alone or in combination with the optical device, generates a control signal. The control signal may be used to regulate one of the processing stations of the printing machine.

22 Claims, 3 Drawing Sheets

QUALITY CONTROL FOR MAGNETIC IMAGES

This invention relates generally to a printing machine, and more particularly concerns a printing machine in which the quality of a magnetic image is controlled.

In a typical electrophotographic printing process, a photoconductive member is charged to a substantially uniform potential so as to sensitize the surface thereof. The charged portion of the photoconductive member is exposed to a light image of an original document being reproduced. Alternatively, a raster output scanner generating a modulated light beam, i.e. a laser beam, may be used to discharge selected portions of the charged photoconductive surface to record the desired information thereon. In this way, exposure of the charged photoconductive member selectively dissipates the charge in the irradiated areas to record an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

Electrophotographic printing has been particularly useful in the commercial banking industry by reproducing checks or other financial documents with magnetic ink, i.e. by fusing magnetic marking or toner particles thereon. Each financial document has imprinted thereon encoded data in a magnetic ink character recognition (MICR) format. In addition, high speed processing of financial documents is simplified by imprinting magnetic ink bar codes in machine readable form thereon. The repeated processing of the financial documents and the high speed sorting thereof is greatly simplified by the reading of the encoded data by an MICR. Thus, encoded information on financial documents may be printed with magnetic ink or toner. The information reproduced on the copy sheet with the magnetic particles may be subsequently read due to its magnetic characteristics. Hereinbefore, high speed electrophotographic printing machines have used magnetic toner particles for printing in the MICR format and non-magnetic toner particles for other types of printing. In either case, the toner particles have been subsequently transferred from the latent image to the copy sheet and fused thereto. Acceptable magnetic readability of the MICR text is a critical requirement for the printer. Hereinbefore, acceptable print characteristics have been maintained by conventional developability control schemes. However, the developability control either senses a developability surrogate, i.e. toner concentration, development current, etc., or senses a developed mass in the range where the sensor is sensitive, generally at intermediate solid area densities. The magnetic parameter level is inferred from surrogates at a risk of introducing uncertainties into the control loop and making the control band unacceptably wide. While the utilization of magnetically encoded information on documents reproduced with magnetic toner is well known, this information has not generally been used to control the processing stations of the printing machine or to continuously sense the developed image. Previously, light detectors have been used to measure the reflectivity of light rays reflected from the toner particles developed on the latent image or on a sample test patch. However, a light detector may lose sensitivity at higher toner mass coverage and may not be able to prevent over developed images. In future products, it will be necessary to control copy quality for both magnetic and non-magnetic particles over a wide latitude in a reliable manner. The present invention provides such a technique. The following disclosures appear to be relevant:

U.S. Pat. No. 4,563,086,
Patentee: Knapp et al.,
Issued: Jan. 7, 1986;
U.S. Pat. No. 4,372,672,
Patentee: Pries,
Issued: Feb. 8, 1983;
U.S. Pat. No. 4,312,589,
Patentee: Brannan et al.,
Issued: Jan. 26, 1982;
U.S. Pat. No. 3,993,484,
Patentee: Rait et al.,
Issued: Nov. 23, 19876;
U.S. Pat. No. 3,858,514,
Patentee: Deede et al.,
Issued: Jan. 7, 1975.

The relevant portions of the foregoing patents may be summarized as follows:

U.S. Pat. No. 4,563,086 discloses an electrophotographic printing machine using magnetic toner particles for reproducing copies with magnetic ink in a MICR format. After the toner image is fused to the copy sheet, it is magnetized and the intensity of the magnetic field measured by a read head adjacent the copy sheet. The output from the read head is processed by a logic circuit and converted into a control signal for regulating processing stations in the printing machine.

U.S. Pat. No. 4,372,672 describes a light source which produces light rays that are reflected from a toned sample test area to a phototransistor. The toned sample may be on the photoconductor or the copy paper. A circuit controls the density of the toned samples such that the reflectance ratio of the toned-to-untoned photoconductor remains constant. Density control is achieved by adjusting the toner concentration in the developer mix to maintain constant output copy density.

U.S. Pat. No. 4,312,589 discloses a light emitting diode which illuminates a toned patch and a clean area of a photoconductor. A photosensor detects the light reflected from the toned patch and clean area. The signal from the photosensor is processed and used to adjust charging of the photoconductor. When the photoconductor's charge magnitude has been increased to at, or near, the working magnitude and the toned patch is of too low a density, additional toner is added to the developer.

U.S. Pat. No. 3,993,484 describes an electrostatic latent image recorded on a tape that is developed with magnetic toner particles. A magnetic image corresponding to the electrostatic latent image is formed on the tape. The toner particles are transferred to a copy paper and fused thereto. The magnetic image may be re-used, or it can be scanned and used to generate electrical images indicative of the information and the signals stored.

U.S. Pat. No. 3,858,514 discloses a magnetically encoded master source document which is superimposed adjacent a transfer sheet. A magnetic toner is applied to the transfer sheet and selectively attracted thereto forming a magnetic toner image corresponding to the master source document. The toner image is then fused to the transfer sheet and machine read by a pick-up device which may be an optical or magnetic character recognition device. The signals from the pick-up device are transmitted to a computer.

In accordance with one aspect of the present invention, there is provided a printing machine of the type in which magnetically permeable marking particles develop a latent image recorded on a member. The improvement includes a read head positioned adjacent the member to detect magnetic field intensity effects produced by the marking particles developed on the member and, in response thereto, to generate a signal.

Pursuant to another aspect of the features of the present invention, there is provided an electrophotographic printing machine of the type in which a latent image recorded on a moving photoconductive member is developed with magnetically permeable toner particles. The improvement includes means, positioned adjacent the photoconductive member, for detecting magnetic field intensity effects produced by the toner particles developed on the photoconductive member. Means transmit a light beam onto the toner particles developed on the photoconductive member and sense the intensity of the light rays reflected therefrom. Means, responsive to the signal from the detecting means and the signal from the transmitting means, generate a control signal.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents, as may be included within the spirit and scope of the invention as defined by the appended claims.

Figure 1:
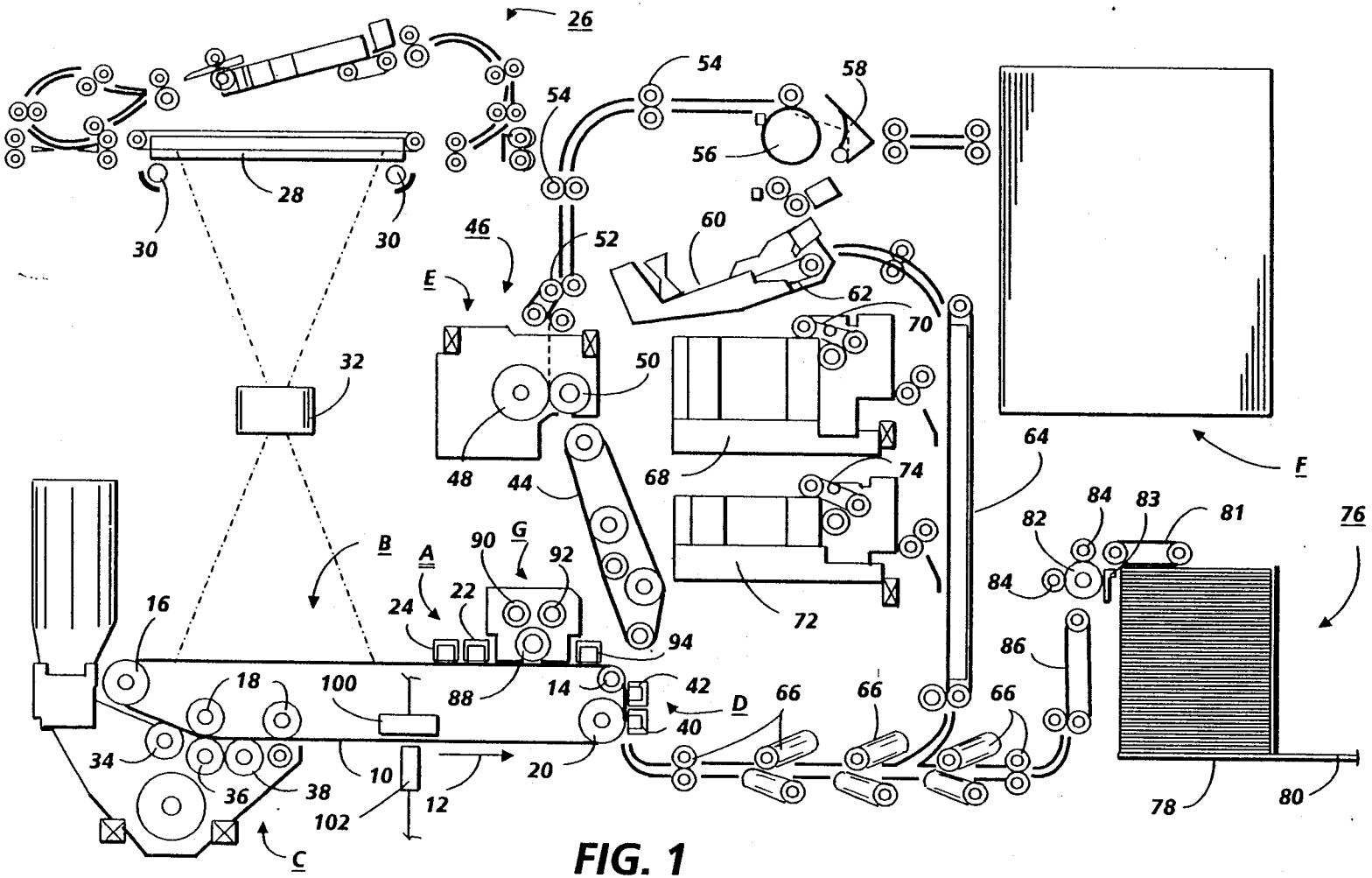
FIG. 1 is a schematic elevational view depicting an illustrative electrophotographic printing machine incorporating the features of the present invention therein.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the present invention may be employed in a wide variety of printing machines and is not specifically limited in its application to the particular embodiment depicted herein.

Referring to FIG. 1 of the drawings, the electrophotographic printing machine employs a photoconductive belt 10. Preferably, the photoconductive belt 10 is made from a photoconductive material coated on a ground layer, which, in turn, is coated on a anti-curl backing layer. The photoconductive material is made from a transport layer coated on a generator layer. The transport layer transports positive charges from the generator layer. The interface layer is coated on the ground layer. The transport layer contains small molecules of di-m-tolydiphenylbiphenyldiamine dispersed in a polycarbonate. The generation layer is made from trigonal selenium. The grounding layer is made from a titanium coated Mylar. The ground layer is very thin and allows light to pass therethrough. Other suitable photoconductive materials, ground layers, and anti-curl backing layers may also be employed. Belt 10 moves in the direction of arrow 12 to advance successive portions of the photoconductive surface sequentially through the various processing stations disposed about the path of movement thereof. Belt 10 is entrained about stripping roller 14, tensioning roller 16, idler rollers 18, and drive roller 20. Stripping roller 14 and idler rollers 18 are mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of the photoconductive surface passes through charging station A. At charging station A, two corona generating devices, indicated generally by the reference numerals 22 and 24, charge the photoconductive belt 10 to a relatively high, substantially uniform potential. Corona generating device 22 places all of the required charge on photoconductive belt 10. Corona generating device 24 acts as a leveling device, and fills in any areas missed by corona generating device 22.

Next, the charged portion of the photoconductive surface is advanced through imaging station B. At imaging station B, a document handling unit, indicated generally by the reference numeral 26, is positioned over platen 28 of the printing machine. Document handling unit 26 sequentially feeds original documents from a set of documents placed by the operator face up in a normal forward collated order in the document stacking and holding tray. A document feeder located below the tray forwards the bottom document in the set to a pair of take-away rollers. The bottom sheet is then fed by the rollers through a document guide to a feed roll pair and belt. The belt advances the document to platen 28. After imaging, the original document is fed from platen 28 by the belt into a guide and feed roll pair. The document then advances into an inverter mechanism and back to the top of the set of original documents through the feed roll pair. A position gate is provided to divert the document to the inverter or to the feed roll pair. Imaging of a document is achieved by lamps 30 which illuminate the document on platen 28. Light rays reflected from the document are tranmitted through lens 32. Lens 32 focuses light images of the original document onto the charged portion of photoconductive belt 10 to selectively dissipate the charge thereon. This records an electrostatic latent image on the photoconductive belt which corresponds to the informational areas contained within the original document.

One skilled in the art will appreciate that a raster output scanner (ROS) may be used in lieu of a light lens system. The ROS uses a laser whose beam is modulated. The modulated light beam is directed onto the charged region of the photoconductive belt 10 to selectively dissipate the charge thereon. This records an electrostatic latent image on the photoconductive belt containing the desired information. After the electrostatic latent image is recorded on photoconductive belt 10, the latent image is advanced to development station C.

One skilled in the art will appreciate that the light lens system or ROS may be arranged to record a sample electrostatic latent image or test patch on photoconductive belt 10 in the interdocument area. The sample electrostatic latent image or test patch is then developed with toner particles at development station C. In this way, a sample toner powder image or a developed test patch is formed on photoconductive belt 10 in the interdocument area. 'The developed test patch is subsequently examined to determine the quality of the toner image being developed on the photoconductive belt.

Referring now to development station C, development station C has three magnetic brush developer rolls, indicated generally by the reference numerals 34, 36 and 38. A paddle wheel picks up developer material and delivers it to the developer rolls. When developer material reaches rolls 34 and 36, it is split between the rolls with half the developer material being delivered to each roll. Photoconductive belt 10 is partially wrapped about rolls 34 and 36 to form extended development zones. Developer roll 38 is a cleanup roll. A magnetic roll, positioned after developer roll 38, in the direction of arrow 12, is a carrier granule removal device adapted to remove any carrier granules adhering to belt 10. Thus, rolls 34 and 36 advance developer material into contact with the electrostatic latent image and test patch recorded on photoconductive belt 10. The latent image and test patch attract toner particles from the carrier granules of the developer material to form a toner powder image on the photoconductive surface of belt 10. When printing in MICR format, the toner particles are magnetically permeable and are preferably made from a ferromagnetic material, such as magnetite embedded in a resin binder. Alternatively, when printing conventional documents, a non-magnetic toner may be used. After the test patch is developed, it moves with belt 10 in the direction of arrow 12, to transfer station D. A read head 100 and an optical density detector 102 are positioned on either side of belt 10 intermediate development station C and transfer station D.

Read head 100 is positioned adjacent the surface of belt 10 opposed from the surface having the developed test patch and toner powder image thereon, i.e. adjacent the backside of the photoconductive belt. Photoconductive belt 10 is only about 0.003 inches thick and this thickness, which separates read head 100 from the developed layer of magnetic toner, is very uniform. This insures that measurements are repeatable between different photoconductive belts and that the system has adequate sensitivity. The photoconductive belt slides over read head 100 either in permanent contact, or the read head may be in the operative position only when the printing machine is using magnetic toner in the MICR mode of operation. In one embodiment, read head 100 generates a constant magnetic flux field. Thus, as the photoconductive belt advances the magnetically permeable toner particles developed on the test patch past read head 100, the magnetically permeable toner particles modulate the magnetic flux field. In response thereto, read head 100 generates a signal. Read head 100 includes an electromagnet or a permeable magnet and a magnetic transducer which may be a single gap magnetic transducer or any other suitable magnetic transducer known to those skilled in the art. Hence, the magnetically permeable toner particles modulate the existing magnetic flux field and, in response thereto, the read head generates a signal. In another embodiment, the read head includes an electromagnet which magnetizes the toner particles with a moderate magnetic field. A single gap magnetic transducer measures the intensity of the magnetic field generated by the toner particles and generates a signal in response thereto. The magnetic field generated by the magnetic toner developed on the test patch induces a voltage in the single gap magnetic transducer of read head 100 proportional to the magnetite mass on photoconductive belt 10. In this way, read head 100 generates an output signal dependent upon the toner particles developed on the test patch. Preferably, the developed test patch is a plurality of spaced lines extending in a direction perpendicular to the direction of movement of belt 10, as indicated by arrow 12. The resulting magnetic toner patch is a line pattern with the lines being perpendicular to the direction of motion of photoconductive belt 10. With every line moving under the read head, the magnetic flux through the read head increases and again decreases as the line moves in and out of range. The voltage induced in the read head is proportional to the time derivative of the magnetic flux change so that the read head generates an AC voltage signal.

Optical density detector 102 is opposed from the surface of photoconductive belt 10 having the developed test patch thereon. The density detector is spaced from belt 10 and does not contact the toner test patch or latent image. Optical density detector 102 includes a light source, i.e. a light emitting diode (LED), and a light sensor, i.e. a photodiode. The LED transmits light rays onto the developed test patch and the intensity of the light rays reflected therefrom is detected by the photodiode. Inasmuch as the toner patch is a line pattern with the lines being perpendicular to the direction of motion of photoconductive belt 10, the photodiode generates an AC voltage signal.

In the MICR mode of operation, i.e. when magnetically permeable toner is used, read head 100 may be used alone or in combination with optical density detector 102 to provide a control signal for regulating the various processing stations with the printing machine to achieve the desired image quality. When non-magnetic toner is used, the read head need not be used and the optical density detector alone may be employed to generate a control signal. Thus, when in the MICR mode of operation, the read head will generate an AC voltage signal as the control signal which provides a measure of the magnetic, high mass per area. If the optical density detector is also used, it will generate an AC voltage signal as well which provides a measure of the mid-density range and a reference signal. The photoconductive belt continues to advance the developed latent image to transfer station D.

At transfer station D, a copy sheet is moved into contact with the toner powder image. First, photoconductive belt 10 is exposed to a pre-transfer light from a lamp (not shown) to reduce the attraction between photoconductive belt 10 and the toner powder image. Next, a corona generating device 40 charges the copy sheet to the proper magnitude and polarity so that the copy sheet is tacked to photoconductive belt 10 and the toner powder image attracted from the photoconductive belt to the copy sheet. After transfer, corona generator 42 charges the copy sheet to the opposite polarity to detack the copy sheet from belt 10. Conveyor 44 advances the copy sheet to fusing station E.

Fusing station E includes a fuser assembly, indicated generally by the reference numeral 46 which permanently affixes the transferred toner powder image to the copy sheet. Preferably, fuser assembly 46 includes a heated fuser roller 48 and a pressure roller 50 with the powder image on the copy sheet contacting fuser roller 48.

Afer fusing, the copy sheets are fed through a decurler 52. Decurler 52 bends the copy sheet in one direction to put a known curl in the copy sheet and then bends it in the opposite direction to remove that curl.

Forwarding rollers 54 then advance the sheet to duplex turn roll 56. Duplex solenoid gate 58 guides the sheet to the finishing station F or to duplex tray 60. At finishing station F, copy sheets are stacked in compiler trays to form sets of copy sheets. The sets of copy sheets may remain unfinished or may be finished by being attached to one another by either a binding device or a stapling device. The finished sets of copy sheets are delivered to a stacker.

With continued reference to FIG. 1, when duplex solenoid gate 58 diverts the sheet into duplex tray 60. Duplex tray 60 provides an intermediate or buffer storage for those sheets that have been printed on one side and on which an image will be subsequently printed on the second, opposed side thereof, i.e. the sheets being duplexed. The sheets are stacked in duplex tray 60 face down on top of one another in the order in which they are copied. The simplex sheets are fed, in seriatim, by bottom feeder 62 from tray 60 back to transfer station D via conveyor 64 and rollers 66 for transfer of the toner powder image to the opposed sides of the copy sheets. Inasmuch as successive bottom sheets are fed from duplex tray 60, the proper or clean side of the copy sheet is positioned in contact with belt 10 at transfer station D so that the toner powder image is transferred thereto. The duplex sheet is then fed through the same path as the simplex sheet to be advanced to finishing station F.

Copy sheets are fed to transfer station D from the secondary tray 68. The secondary tray 68 includes an elevator driven by a motor up or down. When the tray is in the down position, stacks of copy sheets are loaded thereon or unloaded therefrom. In the up position, successive copy sheets may be fed therefrom by sheet feeder 70 to transport 64 which advances the sheets to rolls 66 and then to transfer station D.

Copy sheets may also be fed to transfer station D from the auxiliary tray 72. The auxiliary tray 72 includes an elevator driven by a motor up or down. When the tray is in the down position, stacks of copy sheets are loaded thereon or unloaded therefrom. In the up position, successive copy sheets may be fed therefrom by sheet feeder 74 to transport 64 which advances the sheets to rolls 66 and then to transfer station D.

Secondary tray 68 and auxiliary tray 72 are secondary sources of copy sheets. A high capacity feeder, indicated generally by the reference numeral 76, is the primary source of copy sheets. High capacity feeder 76 includes a tray 78 supported on an elevator 80. The elevator is driven by a motor to move the tray up or down. In the up position, the copy sheets are advanced from the tray to transfer station D. A fluffer and air knife 83 direct air onto the stack of copy sheets on tray 78 to separate the uppermost sheet from the stack of copy sheets. A vacuum pulls the uppermost sheet against feed belt 81. Feed belt 81 feeds successive uppermost sheets from the stack to an take-away drive roll 82 and idler rolls 84. The drive roll and idler rolls guide the sheet onto transport which advances the sheet to rolls 66. Rolls 66 move the sheet to transfer station station D.

After transfer, photoconductive belt 10 is cleaned by passing beneath corona generating device 94 which charges the residual toner particles to the proper polarity. Thereafter, the pre-charge erase lamp (not shown), located inside photoconductive belt 10, discharges the photoconductive belt in preparation for the next charging cycle. Residual particles are removed from the photoconductive surface at cleaning station G. Cleaning station G includes an electrically biased cleaner brush 88 and two de-toning rolls 90 and 92, i.e. waste and reclaim de-toning rolls. The reclaim roll is electrically biased negatively relative to the cleaner roll so as to remove toner particles therefrom. The waste roll is electrically biased positively relative to the reclaim roll so as to remove paper debris and wrong sign toner particles. The toner particles on the reclaim roll are scraped off and deposited in a reclaim auger (not shown), where it is transported out of the rear of cleaning station G.

The various machine functions are regulated by a controller. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the documents and the copy sheets. In addition, the controller regulates the various positions of the gates depending upon the mode of operation selected.

Figure 2:
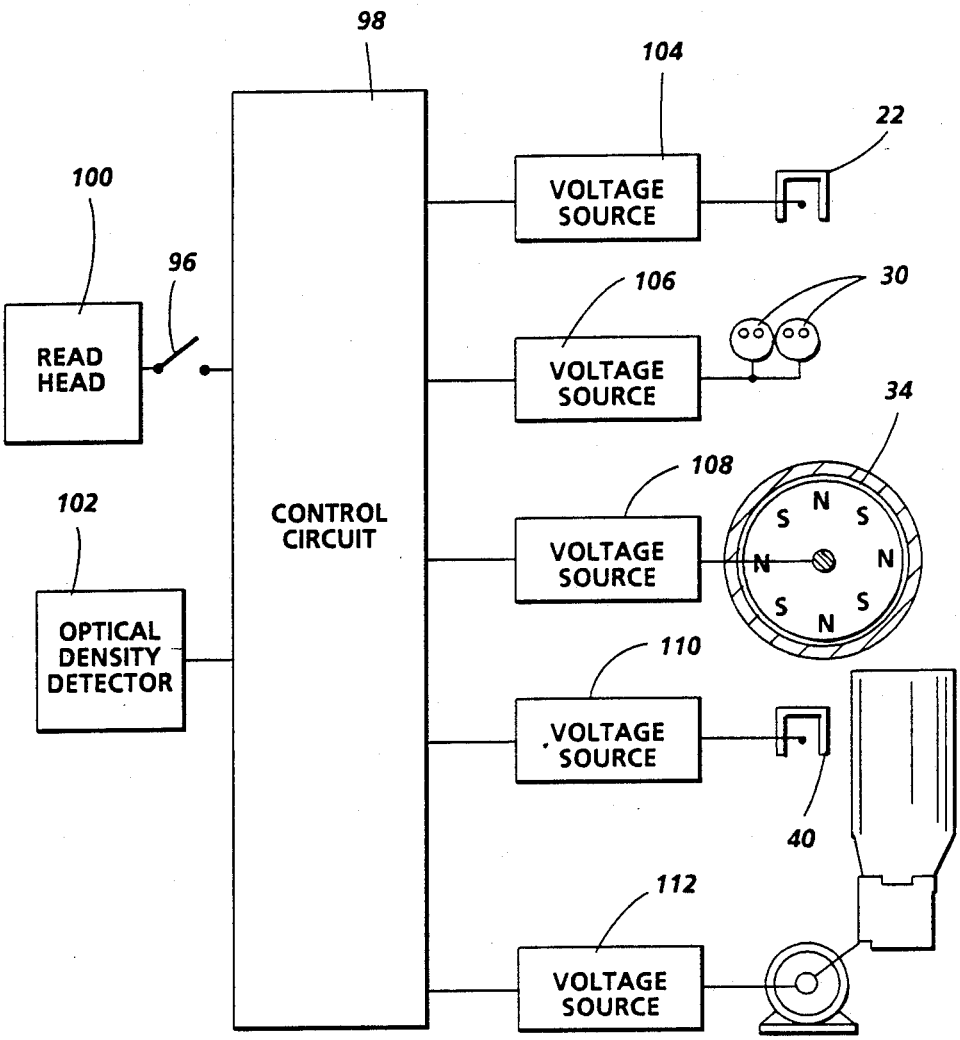
FIG. 2 is a schematic elevational view showing the control system for the FIG. 1 printing machine.

Referring now to FIG. 2, when in the MICR mode of operation and magnetic toner particles are being used, switch 96 is closed coupling read head 100 to control circuit 98. When non-magnetic toner is used, switch 96 may be in the open position disconnecting read head 100 from control circuit 98. In the MICR mode of operation with switch 96 closed, read head 100 transmits an AC control signal to control circuit 98. Substantially simultaneously, optical density detector 102 also transmits an AC reference signal to control circuit 98. The developed toner patch generates a magnetic flux field, the intensity of which induces an AC voltage in read head 100. Read head 100 generates an AC control signal which is transmitted to control circuit 98. The LED of optical density detector 102 illuminates the developed toner patch and the intensity of the light reflected therefrom is measured by the photodiode therein. The photodiode of optical density detector 102 transmits an AC reference signal to control circuit 98. Control circuit 98 processes the signals from read head 100 and optical density detector 102 and generates a control signal as a function thereof. The control signal regulates various processing stations of the printing machine. The control signal from control circuit 98 regulates the output voltage from voltage source 104 to control corona generator 22. The output from corona generator 22 is thus regulated to vary as a function of the control signal from control circuit 98 which, in turn, is a function of the quality of the toner image developed on the test patch. Thus, corona generator 22 is regulated to produce a charge sufficient to maintain photoconductive belt 10 at a preselected potential, irrespective of variations in conditions. Control circuit 98 also controls lamps 30 of exposure station B. Alternatively, control circuit 98 may control a ROS in lieu of lamps 30. The control signal from control circuit 98 regulates voltage source 106 which, in turn, defines the intensity of the light rays emitted from lamps 30 during the flashing thereof. Control circuit 98 regulates the electrical bias on developer rollers 34, 36 and 38. Since the control scheme is the same for each of the developer rollers, only developer roller 34 is shown in FIG. 2. Developer roller 34 includes a non-magnetic tubular member journalled for rotation. A magnetic member is disposed interiorly of and spaced from the tubular member. Voltage source 108 electrically biases the tubular member to a suitable polarity and magnitude. This selected electrical bias is intermediate the potential of the latent image and the background regions of photoconductive belt 10. The control signal from control circuit 98 is employed to regulate the output voltage from voltage source 108. In this way, the electrical bias applied to the tubular member of developer roller 34 is controlled to optimize development of the latent image recorder on photoconductive belt 10. Control circuit 98 also transmits a control signal to voltage source 110 which is coupled to corona generator 40 at transfer station D. The control signal regulates the output voltage from voltage source 110 so as to control corona generator 40. Thus, corona generator 40 produces a charge sufficient to transfer the toner powder image from photoconductive belt 10 to the copy sheet, irrespective of conditions. As toner particles are depleted from the developer mixture during the development process, additional toner particles are furnished thereto. Control circuit 98 also controls the furnishing of additional toner particles into the developer housing in development station C. Control circuit 98 transmits a control signal to a motor which rotates an auger for dispensing toner particles from a storage container. Energization of the motor is controlled by voltage source 112. In this way, dispensing of additional toner particles into the development system is controlled by control circuit 98.

Figure 3:
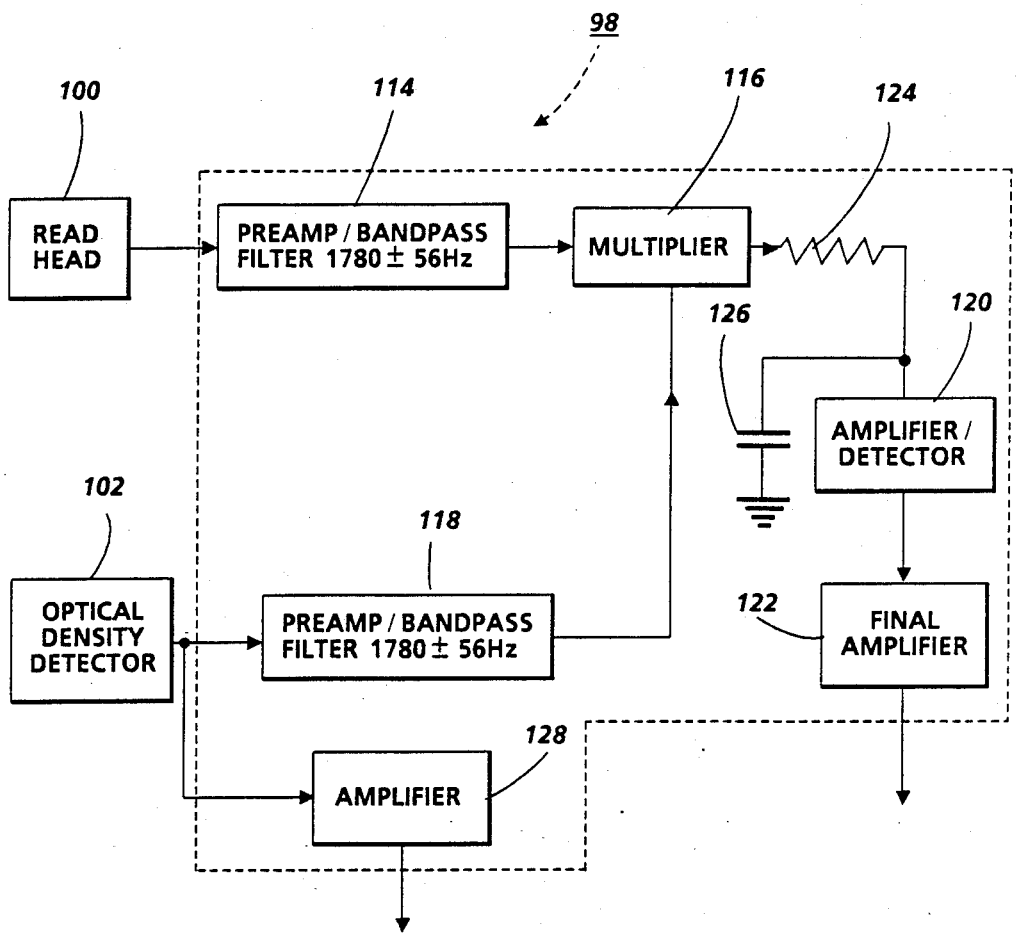
FIG. 3 is a circuit diagram showing the FIG. 2 control circuit in greater detail.

An exemplary circuit for use as control circuit 98 is shown in FIG. 3. One skilled in the art will appreciate that the circuit depicted in FIG. 3 is essentially a synchronous detection circuit. As depicted thereat, read head 100 and optical density detector 102 simultaneously detect the line pattern of the toner patch developed on photoconductive belt 10. The AC signal from read head 100 is transmitted to a bandpass filter 114. Similarly, the AC reference signal from optical density detector 102 is transmitted to bandpass filter 118. The output signal from filter 118 is the reference signal for the synchronous detection of the magnetic signal. In addition, the signal from optical density detector 102 may be transmitted to amplifier 128. The output signal from amplifier 128 is an additional control signal based on the measurement of the average optical density of the toner line patch and may also be used as a control signal to regulate various processing stations within the printing machine. Filters 114 and 118 are bandpass filters in the pre-processing stages. The filtered signals from the respective bandpass filters are transmitted to multiplier 116. The output signal from the multiplier passes through a resistor 124 connected to capacitor 126, and then to amplifier 120. The gain of the signal from amplifier 120 is increased to the appropriate level by amplifier 122. The output from amplifier 122 is the control signal derived from the magnetic measurement. The signal from read head 100 and optical density detector 102 are in phase. This is accomplished by the design parameters and by using, if necessary, an appropriate phase lock circuit. The signal from the read head is multiplied by the signal from the optical density detector which results in a DC signal, as well as the sidebands. To reduce the noise component, the circuit lets through only the DC voltage proportional to the signal from read head 100 and suppresses the sideband and most of the noise. An example of this is for the case in which the speed of the photoconductive belt is 14 inches/second, the test patch is about 20 millimeters with the line width of the patch being about 0.2 millimeters with the distance between lines being about 1 millimeter. Under these conditions, the processing frequency ($F_0$) is 890 Hertz. The side bands and the central DC band are sufficiently narrow not to overlap and permit low pass filtering. Resistor 124, capacitor 126 and detector 120 form a low pass filter which provides enough suppression, about 22 decibels, at 1780 Hertz, where the side bands are centered, with a time constant ($T_0$) of about $\frac{1}{4}$ the toner patch passage period, i.e. about 0.014 seconds, permitting reliable averaging prior to the patch exit. The signal from read head 100, neglecting noise, may be expressed as $$V(t)=V_0G(t/T_0)\cos W_0t$$

where $G(t/T_0)$ is the gate operator, $G(x)=1$ for $-\frac{1}{2}<x<+\frac{1}{2}$, and otherwise 0, and $W_0=2(Pi)(F_0)$. The signal from optical density detector 102, neglecting noise, may be expressed as $$V_r(t)=V_{0r}G(t/T_0)\cos W_0t$$

where $G(t/T_0)$ is the gate operator, $G(x)=1$ for $-\frac{1}{2}<x<+\frac{1}{2}$, and otherwise 0, and $W_0=2PiF_0$. The signal from bandpass filter 114 may be expressed as $$V(t)=V_0G(t/T_0)\cos W_0t+\text{noise}.$$

The signal from bandpass filter 118 may be expressed as $$V_r(t)=V_{0r}G(t/T_0)\cos W_0t$$

The signal from multiplier 116 may be expressed as $$V_{out}=(\tfrac{1}{2})V_0V_{0r}G(t/T_0)(1+\cos 2W_0t)+\text{noise}.$$

The low pass filter formed from resistor 124, capacitor 126 and detector 120 suppress the AC component of $\cos 2W_0t$ so that the output from detector 120 is $V_{out}=(\frac{1}{2})V_0V_{0r}G(t/T_0)$. This voltage is transmitted to amplifier 122 and the control signal from amplifier 122 is proportional to the average $V_0$. Thus, the the resultant output signal is proportional to the voltage reading of read head 100.

In recapitulation, the printing machine of the present invention employs a read head for detecting the magnetic field intensity effects of the generated by the magnetically permeable toner patch on a photoconductive belt. This signal is processed by a control circuit which may also receive signal from an optical density detector measuring the density of the toner particles developed on the patch. These signals are processed and a control signal generated which is used to regulate the processing stations in the printing machine to insure that copy quality is optimized for printing in an MICR format.

It is, therefore, evident that there has been provided, in accordance with the present invention, a printing machine that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

I claim:

1. A printing machine of the type in which magnetically permeable marking particles develop a latent image recorded on a member, wherein the improvement includes a read head positioned adjacent the member to detect magnetic field intensity effects produced by the marking particles developed on the member and, in response thereto, generates a signal.

2. A printing machine according to claim 1, wherein said read head is positioned adjacent the surface of the member opposed from the surface having the marking particles thereon.

3. A printing machine according to claim 2, further including means for recording a test patch as the latent image on the member.

4. A printing machine according to claim 1, further including optical means which transmits a light beam onto the marking particles developed on the test patch and which senses the intensity of the light rays reflected therefrom and, in response thereto, generates a signal.

5. A printing machine according to claim 4 in which the member moves the developed test patch, wherein the developed test patch includes a plurality of spaced lines with the lines being perpendicular to the direction of movement of the member.

6. A printing machine according to claim 5, wherein the marking particles developed on the test patch interact with said read head so that the signal generated by said read head is an AC signal.

7. A printing machine according to claim 6, wherein the marking particles developed on test patch interact with said optical means so that the signal generated by said optical means is an AC signal.

8. A printing machine according to claim 7, further including means, responsive to the signal from said read head and the signal from said optical means, for generating a control signal to regulate a processing station of the printing machine.

9. A printing machine according to claim 8, wherein said read head generates a substantially constant magnetic flux field and detects the variations of the magnetic flux field caused by the marking particles developed on the test patch.

10. A printing machine according to claim 8, wherein said read head magnetizes the marking particles and detects the intensity of the magnetic field generated by the marking particles.

11. A printing machine according to claim 8, wherein said optical means includes:

a light source for transmitting light rays onto at least the marking particles developed on the test patch recorded on the member; and a light sensor for detecting the intensity of the light rays reflected from the marking particles developed on the test patch recorded on the member.

12. An electrophotographic printing machine of the type in which a latent image recorded on a moving photoconductive member is developed with magnetically permeable toner particles, wherein the improvement includes:

means, positioned adjacent the photoconductive member, for detecting the magnetic field intensity effects produced by the toner particles developed on the photoconductive member and, in response thereto, generating a signal;

means for transmitting a light beam onto the toner particles developed on the photoconductive member and which senses the intensity of the light rays reflected therefrom and, in response thereto, generates a signal; and means, responsive to the signal from said detecting means and the signal from said transmitting means, for generating a control signal.

13. A printing machine according to claim 12, further including means, responsive to the toner particles being non-magnetic, for decoupling said control means from said detecting means.

14. A printing machine according to claim 12, wherein said detecting means is positioned adjacent the surface of the photoconductive member opposed from the surface thereof having the toner particles thereon.

15. A printing machine according to claim 14, further including means for recording a test patch as the latent image on the photoconductive member member.

16. A printing machine according to claim 15, wherein the developed test patch includes a plurality of spaced lines with the lines being perpendicular to the direction of movement of the photoconductive member.

17. A printing machine according to claim 16, wherein the toner particles developed on the test patch interact with said detecting means so that the signal generated by said detecting means is an AC signal.

18. A printing machine according to claim 17, wherein the toner particles developed on the test patch interact with said transmitting means so that the signal from said transmitting means is an AC signal.

19. A printing machine according to claim 18, wherein said detecting means magnetizes the toner particles and detects the intensity of the magnetic field generated by the toner particles.

20. A printing machine according to claim 18, wherein detects means generates a substantially constant magnetic flux field and detects the variations of the magnetic flux field caused by the toner particles developed on the test patch.

21. A printing machine according to claim 18, the control signal from said generating means regulates a processing station of the printing machine.

22. A printing machine according to claim 21, wherein said transmitting means includes:

a light source for transmitting light rays onto at least the toner particles developed on the test patch recorded on the photoconductive member; and a light sensor for detecting the intensity of the light rays reflected from the toner particles developed on the test patch recorded on the photoconductive member.

* * * * *